US006094959A

United States Patent [19]

Donini et al.

[11] Patent Number: 6,094,959

[45] Date of Patent: Aug. 1, 2000

[54] COMPRESSION UNIT FOR OSCILLATING ROLL

[75] Inventors: Estore Donini, Vimercate; Fausto Drigani, Pozzuolo Del Friuli, both of Italy

[73] Assignee: Danieli & C. Officine Meccaniche SpA, Buttrio, Italy

[21] Appl. No.: 09/218,036

[22] Filed: Dec. 22, 1998

[30] Foreign Application Priority Data

Dec. 24, 1997 [IT] Italy ..... UD97A0243

[51] Int. Cl.[7] ..... B21B 31/07

[52] U.S. Cl. ..... 72/245; 72/241.4; 72/241.8

[58] Field of Search ..... 72/237, 240, 245, 72/248, 241.4, 244, 241.2, 241.8, 242.2

[56] References Cited

U.S. PATENT DOCUMENTS

| | | | |
|---|---|---|---|
| 4,727,741 | 3/1988 | Ushifusa et al. | 72/245 |
| 4,813,259 | 3/1989 | Grocock et al. | 72/245 |

FOREIGN PATENT DOCUMENTS

| | | |
|---|---|---|
| 8703227 | 6/1987 | European Pat. Off. . |
| 489306 | 6/1992 | European Pat. Off. . |
| 955132 | of 0000 | Germany . |
| 1527642 | 4/1970 | Germany . |
| 2261991 | 6/1974 | Germany . |
| 2804007 | 8/1979 | Germany . |

*Primary Examiner*—Rodney Butler
*Attorney, Agent, or Firm*—Antonelli, Terry, Stout & Kraus, LLP

[57] ABSTRACT

Compression unit for oscillating roll, suitable to generate a compression thrust on a surface subject to translatory movements on a plane which does not contain the axis on which the compression thrust is made. The compression unit include an oscillating plunger body housed inside a stationary housing seating made in a piston element, the plunger body being conformed as a double element spherical cap, the first spherical cap element facing towards the piston element, being entirely contained inside the containing seating cradle and cooperating rotatably, with the inner spherical surface of the seating, the second spherical cap element being partly outside the containing cradle and facing towards the translatable surface and partly cooperating with the at least partly spherical surface of a movable element solid with the translatable surface. Between the first and second spherical cap elements there is placed an annular cylindrical connection and centering element including an elastic ring.

12 Claims, 2 Drawing Sheets

COMPRESSION UNIT FOR OSCILLATING ROLL

FIELD OF THE INVENTION

This invention concerns a compression unit for an oscillating roll.

The compression unit according to the invention is applied to generate a thrust of axial compression on a surface subject to movements of oscillation on a plane substantially orthogonal to the plane where the compression thrust acts.

A preferential use of the compression unit according to the invention is to generate compression and pre-bending thrusts on the chocks of the rolling rolls in a rolling stand equipped with crossing and shifting of the rolls.

BACKGROUND OF THE INVENTION

The state of the art covers the need to generate axial thrusts of compression on surfaces subject to movements of displacement on orthogonal planes, or at least planes which do not contain the axis on which the compression thrust is generated.

These displacement movements of the surface subject to compression cause friction between the end of the pressing element and the moved surface, so that anti-friction materials need to be used which, in time, deteriorate and become worn.

Moreover, the chocks of the hydraulic cylinders which drive the pressure elements are subjected to very strong forces, with a consequent premature wear, damage and loss of airtight grip.

There is also the need to ensure that the pressure element is axially centered and correctly repositioned with respect to the area where the compression thrust is applied on the surface subjected to oscillation movements when this oscillation action stops and the surface returns to its original position.

It is also necessary to ensure extensive connection surfaces even when the surface subjected to compression is in a position where it is displaced at an angle, so that the efficiency of the compression action is maintained in all the reciprocally angled positions.

A typical application refers to the jacks which perform bending actions on the chocks of the rolling rolls, the back-up rolls and/or the working rolls, in a four-high rolling stand for sheet or strip.

The jacks are normally arranged on both sides of the chocks and act alternately with a thrust action so as to generate positive or negative bends on the relative rolls so as to compensate the different deformations of the rolls which are caused by the rolling forces.

The working rolls, together with the back-up rolls, may be subjected, according to the state of the art, to shifting and/or crossing actions which determine a variation in the reciprocal positioning, both axial and angular, of the compression element and the surface which is subject to compression.

Document DE-A-28 04 007 shows a balancing, bending and supporting device for rolls in rolling stands consisting of a piston suitable to act on the chocks of the rolls.

The device described in DE'007 is suitable to act on chocks which are not subject to ample oscillation movements on a plane orthogonal to that on which the piston acts, such as those determined by crossing or shifting movements during the rolling passes, but which are subject only to minimum movements deriving from the play between the chocks and relative supporting elements.

The main purpose of the device described in DE'007 is to eliminate wear on the chocks provided between the piston rod and the walls wherein the rod slides when the slight displacement of the chock inclines the rod with respect to the axial direction and takes it against the chocks.

The device has a piston with a hollow rod containing inside itself, with a defined play, an axial pin equipped with ends shaped like a spherical cap.

The inner end of the axial pin cooperates with a mating spherical shaped seating provided inside the piston rod, while the outer end of the axial pin cooperates with a plane supporting plate made in the chock.

In proximity with the outer end the axial pin has an elastic ring which, cooperating with the walls of the axial hole of the piston rod, has the function of centering the axial pin with respect to the piston rod, and also of restoring the axially centered position thereof after any possible inclination of the said pin caused by the displacement of the chock.

A first disadvantage of this solution is the very limited travel of inclination which the axial pin can assume inside the hole of the piston, which makes it completely unsuitable for use in stands equipped with crossing and/or shifting movements.

Another disadvantage is that the elastic ring, because of its section, is limited in its ability to take the axial pin back on axis with the piston rod.

A further disadvantage is the lengthened and not very compact structure of the piston and the relative rod, which make it unsuitable to support high bending and compensation loads and efforts.

Moreover, the fact that the outer spherical surface of the axial pin acts and slides on a plane surface causes a rapid wear at points of the said surface in correspondence with the area of contact; this generates forces of friction which grow gradually greater and compromise the efficiency of the action of compression.

DE-A-1 527 642 also describes a hydraulic adjustment cylinder with a relative piston which exerts an action of axial compression on the chocks of the rolls in a rolling stand.

In this case it provides that the piston is made in two parts, which are subject to the action of respective flows of oil fed in two distinct zones of the cylinder.

The hydraulic feed made distinctly to the lower and upper parts of the piston causes a yielding coupling of the chock and the pressure element of the piston, which can thus move laterally inside the piston, discharging any possible lateral impacts without the relative stresses affecting the piston.

This solution, like the previous one, is suitable only for minimal lateral displacements of the chocks caused by design play, but not for the ample displacements caused by crossing and shifting movements.

Moreover, this solution does not include any elastic elements to restore the axial position of the thruster element.

Document DE-A-2261991 shows a solution which is similar to the previous one and has the same shortcomings mentioned above.

One solution to the aforementioned problems has been supplied by EP-A-489.306.

This document shows a compression unit comprising a plunger which is axially movable housed in a stationary containing seating. The plunger can oscillate at an angle inside the seating and is associated at its lower part with a floating block defining a spherical connection seating mating with the lower end, in the form of a spherical cap, of the plunger.

The lower surface of the floating block faces towards the base surface of the stationary containing seating and cooperates therewith by means of elastic contrasting means.

At the upper part, the plunger cooperates with centering means consisting of an inclined plane edge on which a segment of surface, shaped like a conical ring, of the plunger itself rests.

The angled oscillation of the plunger is achieved by making the plunger retreat on its axis, against the action of the elastic means included on the lower part, in order to release the plunger from the centering constraint of the conical edge until the lower base of the floating block is made to abut against the base surface of the stationary containing seating.

Then, the plunger is free to oscillate at an angle thanks to the sliding of the coupled spherical surfaces.

This system has a plurality of disadvantages: it has connecting surfaces of a limited extent; it requires the plunger to travel axially, firstly to release itself and then to return to the centered position; it uses a spring outside the plunger to return it to the original axial position, and it uses inclined plane centering means which achieve centering by coupling the surfaces.

To be more exact, the centering action can be achieved only when the surface on which the thruster element of the plunger is acting is distanced therefrom, that is to say, when the plunger does not exert any compression thrust on the said surface.

Moreover, the centering occurs mechanically due to contact between two conical surfaces, and therefore not due to the presence of elastic elements.

In the long term, this leads to localised wear and imperfections in the positioning.

The device described in EP'306 also has an lengthened structure; it is not compact and is not suitable to transmit high forces of compression and compensation.

It should also be stressed that it is complex to achieve and complex in functioning.

The present applicant has designed, tested and embodied this invention to resolve all these disadvantages and to provide a solution which is simpler, more rational, more functional and inexpensive.

SUMMARY OF THE INVENTION

The invention is set forth and characterised in the main claim, while the dependent claims describe other characteristics of the idea of the main embodiment.

According to the invention, the compression unit for movable and oscillating surfaces comprises a plunger body shaped substantially like a double spherical cap housed and contained inside a stationary containing cradle made inside the piston element of the compression unit.

The two spherical caps which constitute the plunger body are separated by a substantially cylindrical connection and centering element.

According to the invention, the spherical cap further inside the containing cradle which faces the piston element, has a large coupling surface with the inner face of the containing cradle, spherical in shape, so that the oscillation of the plunger body is achieved through the reciprocal sliding of the surfaces.

The cylindrical connection and centering element has on its periphery a ring made of deformable elastic material which, when the plunger body is in its axially centered position, rests in its extended condition on the side walls of the inner seating of the containing cradle.

When the plunger body is in the angled oscillation position, caused by the oscillation movement of the surface on which the plunger acts in compression, the deformable elastic material is compressed against the walls, on one side or the other according to the direction of oscillation.

This means that, by providing an elastic ring which is highly compressible and of sufficient thickness, it is possible to achieve ample oscillation travels of the plunger body on both sides with respect to its longitudinal axis.

When the action generating the oscillation stops, the tendency of the elastic material to return to its original using means incorporated in the body of the plunger itself, thus simplifying the construction, the maintenance, the replacement of parts and making the centering action itself more functional.

The spherical cap further towards the outside of the containing cradle is coupled by means of its outer surface with the movable element of the surface which is to be subjected to compression.

A linear translation of the movable element is therefore translated into an angled oscillation of the plunger element by means of sliding at least partly on the inner side the surface of the inner spherical cap on the inner surface of the containing cradle and by sliding on the outer side the surface of the outer spherical cap on the surface of the movable element of the surface which is to be subjected to compression.

When the action generating the oscillation stops, the restoration of the centered position is ensured, as already explained, by the cylindrical connection and centering element.

With an extremely limited number of components and an extremely simplified embodiment, compact, easy to maintain and to dis-assemble, the invention ensures an extremely efficient functioning, limited costs, long lasting performance and a plurality of other advantages in construction and operation.

To be more exact, the invention is suitable to cooperate with supporting surfaces which have a large oscillation range, such as the chocks of rolls which are subjected to crossing or shifting during the rolling passes.

Moreover, thanks to its extremely compact structure, the invention is suitable to exert high thrusts of compression to compensate or generate flections or bends in the chocks themselves.

BRIEF DESCRIPTION OF THE DRAWINGS

The attached Figures are given as a non-restrictive example and show a preferential embodiment of the invention as follows.

DETAILED DESCRIPTION OF PREFERRED EMBODIMENTS

Figure 1:
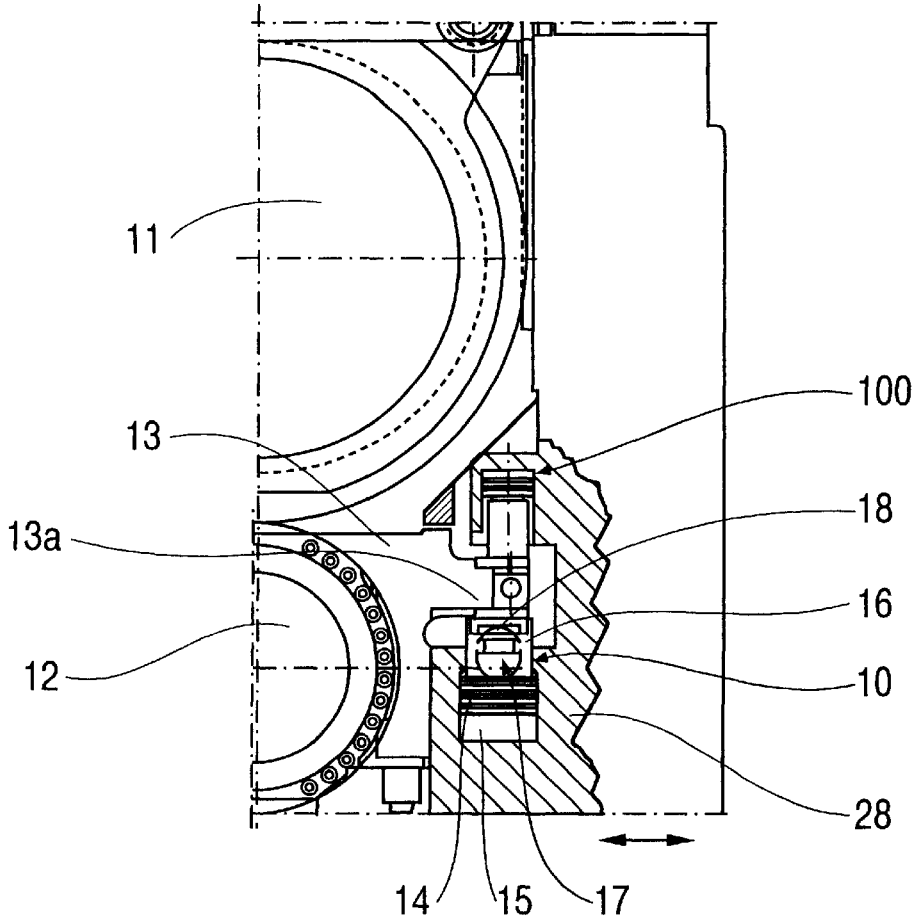
FIG. 1 shows an application of the invention in a four-high rolling stand for strip and sheet, partly shown.

The compression unit 10 according to the invention is applied, in the case shown in FIG. 1, in a four-high rolling stand of which a back-up roll 11 and a working roll 12 are partly shown in the Figure.

Figure 2A:
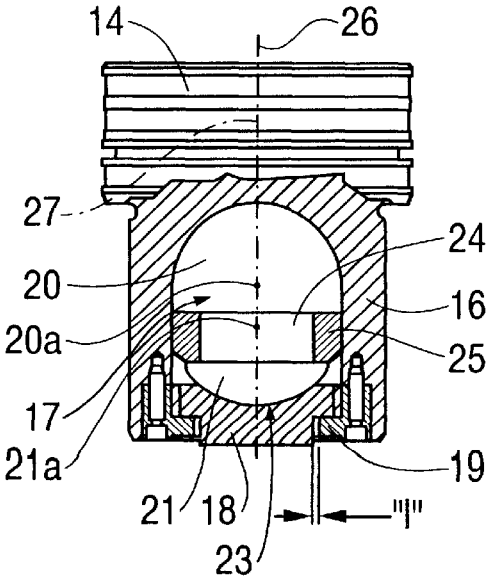
FIG. 2*a* shows the compression unit according to the invention in a first working position.
Figure 2B:
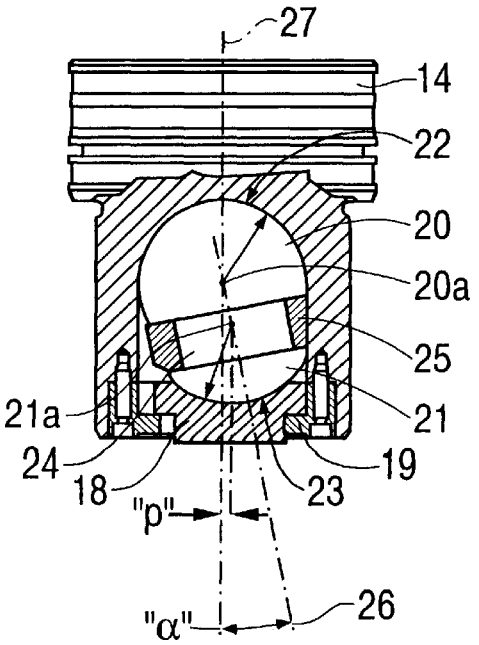
FIG. 2*b* shows the compression unit of FIG. 2*a* in a second working position at an angle to the first.

In this case, in cooperation with the upper and lower faces of a fin 13*a* of the chock 13 on which the working roll 12 is mounted there are, respectively, at the upper part a conventional compression unit 100 and at the lower part a compression unit 10 according to the invention, shown in two operating positions in FIGS. 2*a* and 2*b*.

The compression units 10 and 100 are mounted in respective seatings made on a movable block 28, "L"-type, "C"-type, "F"-type or similar.

Each movable block 28 cooperates laterally with lateral displacement means associated with the stationary housing 29 which induce the crossover displacement of the rolls 11 and 12.

The compression unit 10 comprises a piston element 14 arranged inside a space 15, suitable to receive the hydraulic drive fluid, made in the movable block 28 associated with the relative chock 13 and defining the adjustment travel.

The piston element 14 has a partly hollow rod, at the forward part, wherein there is a containing cradle 16 open at the front, inside which the plunger body 17 is housed. The plunger body 17 is associated with a movable element 18 solid with the chock 13 and acts in pressure against the said element 18.

The movable element 18 has a first axially centered position (FIG. 2*a*) wherein it is placed substantially centered with respect to an abutment ring 19 solid with the front face of the containing cradle 16.

The movable element 18 also has two positions of maximum translation, one towards the right (FIG. 2*b*) and the other towards the left, correlated to the crossover movements imparted to the relative working roll 12, wherein, after a travel "l", the movable element is taken near one side or another of the ring 19.

The plunger body 17 consists of a first inner spherical cap element 20, coupled with the inner spherical surface 22 of the containing cradle 16, and of a second outer spherical cap element 21, coupled with the inner spherical surface 23 of the movable element 18.

The first spherical cap element 20 has a centre of rotation 20*a* while the second spherical cap element 21 has a centre of rotation 21*a*; the elements 20 and 21, in this case, have the same radius.

Between the two spherical cap elements 20 and 21 there is a cylindrical connection and centering element 24.

The cylindrical connection and centering element 24 has a ring 25 on the outer part made of elastic material at least partly deformable which, when the plunger body 17 is in its axially centered position, rests against the inner walls of the containing cradle 16 in a resting position.

When the plunger body 17 is in its centered position as shown in FIG. 2*a*, the two spherical cap elements 20 and 21 are centered in their respective containing seatings and the line 26 joining their centres lies substantially on the median axis 27 of the piston element 14 and the movable element 18.

When a crossover movement is imparted to the working rolls 12, the movable element 18 is laterally translated together with the chock 13 with which it is associated.

The maximum travel allowed to the movable element 18 is less than the maximum crossover displacement required, as determined by the geometry of the system (chocks, rolls, crossing angle) so that preferentially the movable element 18 never enters in contact with the abutment ring 19.

This translation determines the angled oscillation of the plunger body 17 due to the rotation, respectively, of the surface of the second spherical cap element 21 on the spherical surface 23 of the movable element 18 and the first spherical cap element 20 on the inner spherical surface 22 of the containing cradle 16.

The second spherical cap element 21 slides, with respect to the movable element 18, inasmuch as it rotates substantially around the centre of rotation 20*a* of the first spherical cap element 20, since the first spherical cap element 20 is almost entirely surrounded and therefore guided in its movement by the inner spherical wall 22 of the containing cradle 16.

This rotation occurs thanks to the compression, on the side towards which the oscillation is directed, of the ring 25 made of elastically deformable material against the relative wall of the containing cradle 16 (FIG. 2*b*).

The maximum oscillation allowed to the plunger body 17 is equal to the maximum level of compression which can be obtained of the elastic ring 25 from the condition of maximum extension to the condition of maximum compression.

As soon as the action generating the lateral displacement stops, the elasticity of the ring 25 causes an automatic auto-centering, returning the plunger body 17 to the centered position shown in FIG. 2*a*.

Figure 3B:
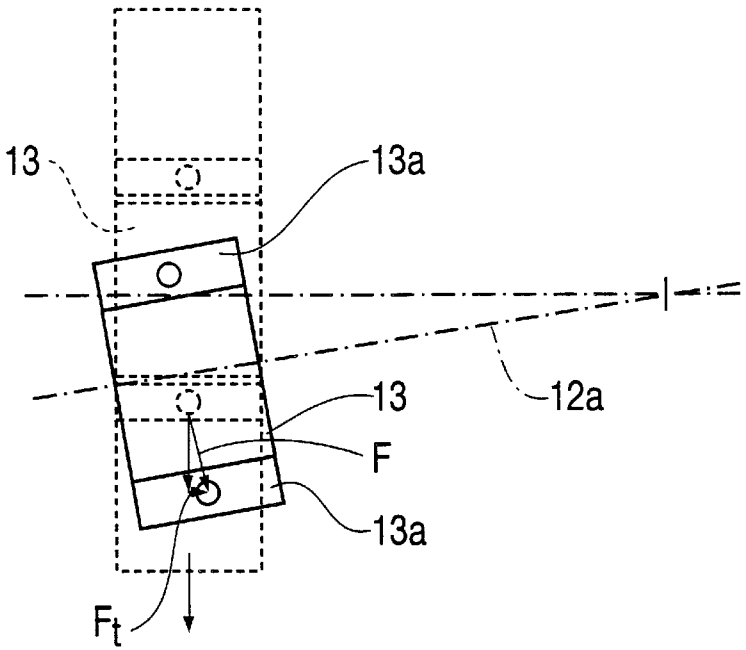
FIGS. 3*a* and 3*b* show two diagrams of the working of the invention.
Figure 3A:
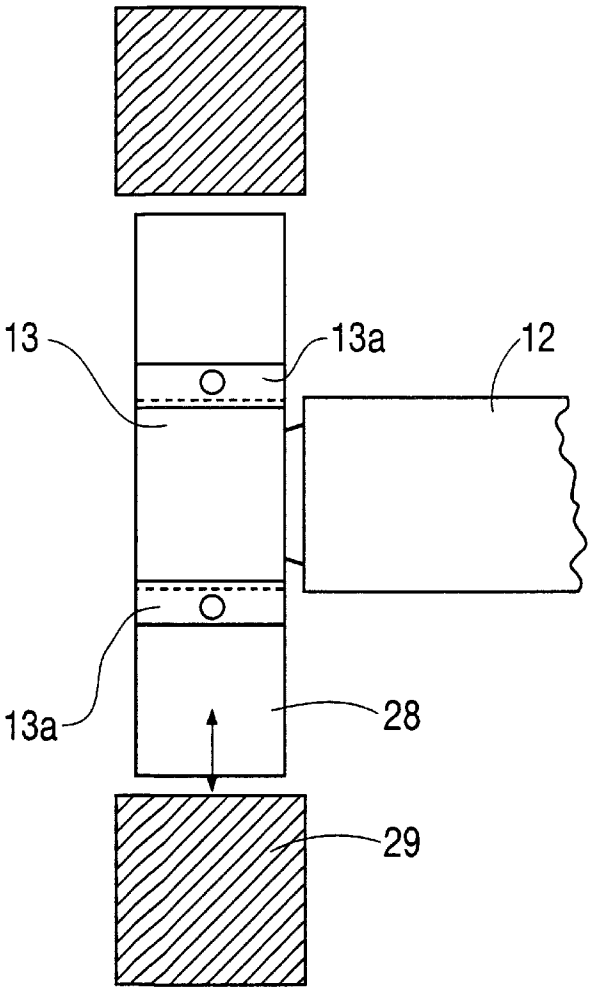

This auto-centering takes place automatically even when there is a condition of contact between the spherical cap 21 and the movable element 18 it the component of tangential force $F_t$ of the thrust F (FIG. 3*b*) produced by the fins 13*a* of the chocks 13, when the roll 12 has its axis 12*a* misaligned with respect to its axial starting position as shown in FIG. 3*a*, does not exceed the force of elastic return produced by the ring 25.

The oscillation of the plunger body 17 determines the misalignment, by an angle "α", of the line 26 joining the centres 20*a* and 21*a* of the spherical cap elements 20 and 21 with respect to the median axis 27 of the piston element 14 and the lateral translation, by a value "p", of the centre 21*a* of the second spherical cap element 21 with respect to this axis 27.

This translation occurs, as already explained, because the second spherical cap element 21 is constrained to rotate substantially around the centre of rotation 20*a* of the first spherical cap element 20.

From the preceding explanations, it can be seen that the compression unit 10 according to the invention, with an extremely limited number of components and without axial displacements or repositioning, greatly facilitates the oscillation of the plunger body 17 together with the rolling rolls, and allows it to be automatically re-positioned, once the tangential force $F_t$, linked to the displacement of the chock 13 and the compression unit 10, is reduced.

In other words, when the bending force generated by the compression unit 10 is reduced to a limited value, for example at the end of rolling, and the compression unit 10 is switched to a balancing pressure, the force $F_t$ is reduced and therefore the elastic energy accumulated by the ring 25 automatically returns the plunger body 17 to its centered position, without necessarily having to distance the chock 13 from the head of the respective plunger.

The compression unit 10 is subject to very little wear, and is extremely easy and quick to assemble and dis-assemble for maintenance operations and the replacement of parts.

Moreover, it has an extremely compact structure which facilitates installation and guarantees the transmission of very high forces of compression and compensation.

What is claimed is:

1. A rolling stand, comprising:

a stationary housing;

a pair of working rolls, each working roll being supported at each end by a chock, the chock being operably connected to a movable block, the movable block being movably connected to the stationary housing by a displacement device for inducing a crossover displacement of the working rolls; and at least one compressor unit provided in a seating of each movable block for generating a compression thrust along an axis not contained within a plane along which the crossover displacement of the respective working roll is induced, the compression unit comprising an oscillating plunger body housed inside a stationary housing seating made in a piston element, the plunger body being conformed as a double element spherical cap having first and second spherical cap elements, the first spherical cap element facing towards the piston element, being entirely contained inside a containing seating cradle and cooperating rotatably with an inner spherical surface of said containing seating cradle, the inner spherical surface having a shape corresponding to a shape of the first spherical cap element, the second spherical cap element being partly outside the containing cradle and facing towards the translatable surface and partly cooperating with an at least partly spherical surface of a movable element solid with the said translatable surface, the at least partly spherical surface having a shape corresponding to a shape of the second spherical cap element, the compression unit being characterised in that between the first and the second spherical cap elements there is placed an annular cylindrical connection and centering element comprising a ring made of an at least partly deformable elastic material, the elastic ring having a force of elastic reaction greater than the tangential component ($F_t$) of the thrust force generated by the translatable surface against the plunger body, when the said surface is in a laterally translated position, in order to allow the restoration of an axially centered position of the plunger body.

2. Rolling stand as in claim 1, characterised in that the elastic ring at least partly abuts against inner walls of the containing seating when the plunger body is in the axially centered position.

3. Rolling stand as in claim 1 or 2, characterised in that the elastic ring made of an at least partly deformable material has a condition of partial compression when the plunger body is in an angled oscillation position.

4. Rolling stand as in claim 1, characterised in that the second spherical cap element rotates with respect to the movable element substantially around a centre of the first spherical cap element.

5. Rolling stand as in claim 1, characterised in that the first spherical cap element is substantially entirely surrounded by a spherical wall of the containing seating.

6. Rolling stand as in claim 1, characterised in that the first spherical cap element and the second spherical cap element have the same radius.

7. Compression unit for oscillating roll, suitable to generate a compression thrust along an axis on a surface subject to translatory movements on a plane which does not contain the axis on which the compression thrust is made, the compression unit comprising an oscillating plunger body housed inside a stationary housing seating made in a piston element, the plunger body being conformed as a double element spherical cap having first and second spherical cap elements, the first spherical cap element facing towards the piston element, being entirely contained inside a containing seating cradle and cooperating rotatably with an inner spherical surface of said containing seating cradle, the inner spherical surface having a shape corresponding to a shape of the first spherical cap element, the second spherical cap element being partly outside the containing cradle and facing towards the translatable surface and partly cooperating with an at least partly spherical surface of a movable element solid with the said translatable surface, the at least partly spherical surface having a shape corresponding to a shape of the second spherical cap element, the compression unit being characterised in that between the first and the second spherical cap elements there is placed an annular cylindrical connection and centering element comprising a ring made of an at least partly deformable elastic material, the elastic ring having a force of elastic reaction greater than the tangential component ($F_t$) of the thrust force generated by the translatable surface against the plunger body, when the said surface is in a laterally translated position, in order to allow the restoration of an axially centered position of the plunger body.

8. Compression unit as in claim 7, characterised in that the elastic ring at least partly abuts against inner walls of the containing seating when the plunger body is in the axially centered position.

9. Compression unit as in claim 7 or 8, characterised in that the elastic ring made of an at least partly deformable material has a condition of partial compression when the plunger body is in an angled oscillation position.

10. Compression unit as in any claim hereinbefore, characterised in that the second spherical cap element rotates with respect to the element of the translatable surface substantially around a centre of the first spherical cap element.

11. Compression unit as in any claim hereinbefore, characterised in that the first spherical cap element is substantially entirely surrounded by a spherical wall of the containing seating.

12. Compression unit as in any claim hereinbefore, characterised in that the first spherical cap element and the second spherical cap element have the same radius.

* * * * *